US012075877B2

(12) United States Patent
Davis

(10) Patent No.: US 12,075,877 B2
(45) Date of Patent: Sep. 3, 2024

(54) SYSTEMS AND METHODS DIRECTED TO FOOTWEAR WITH ADAPTATIONS FOR IMPROVED USABILITY

(71) Applicant: Jazmine Kionna, LLC, Springfield, VA (US)

(72) Inventor: Jazmine Davis, Windsor Mill, MD (US)

(73) Assignee: Jazmine Kionna, Wilmington, DE (US)

( * ) Notice: Subject to any disclaimer, the term of this patent is extended or adjusted under 35 U.S.C. 154(b) by 0 days.

(21) Appl. No.: 16/600,115

(22) Filed: Oct. 11, 2019

(65) Prior Publication Data

US 2020/0113277 A1 Apr. 16, 2020

Related U.S. Application Data

(60) Provisional application No. 62/744,824, filed on Oct. 12, 2018.

(51) Int. Cl.

| | |
|---|---|
| ***A43B 13/12*** | (2006.01) |
| ***A43B 13/02*** | (2022.01) |
| ***A43B 13/18*** | (2006.01) |

(52) U.S. Cl.

CPC ..... *A43B 13/127* (2013.01); *A43B 13/187* (2013.01); *A43B 13/189* (2013.01); *A43B 13/026* (2013.01)

(58) Field of Classification Search

CPC ... A43B 13/127; A43B 13/187; A43B 13/189; A43B 13/026; A43B 13/28; A43B 13/12; A43B 7/00; A43B 9/00; A43B 13/37; A43B 13/386

See application file for complete search history.

(56) References Cited

U.S. PATENT DOCUMENTS

| | | | | |
|---|---|---|---|---|
| 5,012,596 | A * | 5/1991 | Schiller | A43B 13/146 36/11.5 |
| 5,699,627 | A * | 12/1997 | Castro | A43B 1/0045 36/35 R |
| 7,526,880 | B2 * | 5/2009 | Polcek | A43B 17/02 36/43 |
| 7,614,164 | B2 * | 11/2009 | Morales | A43B 7/1445 36/24.5 |
| 10,010,135 | B2 * | 7/2018 | Lovell | A43B 13/386 |
| 10,271,612 | B2 * | 4/2019 | Zake | A43B 7/22 |
| 10,624,416 | B2 * | 4/2020 | Mitchell | A43B 7/142 |
| 2003/0131503 | A1 | 7/2003 | Erickson et al. | |

(Continued)

OTHER PUBLICATIONS

[Author Unknown] Introduction. Sorbothane® Material Properties, Sorbothane Inc., Effective Jan. 27, 2015, 3 pages.

(Continued)

*Primary Examiner* — Khoa D Huynh
*Assistant Examiner* — Haley A Smith
(74) *Attorney, Agent, or Firm* — COOLEY LLP

(57) ABSTRACT

Embodiments described herein relate to an improved footwear and methods for making and using the improved footwear, to provide improved structural support and comfort for a user. Embodiments described herein also relate to an improved footwear including a multi-layered midsole configured to provide improved support and comfort during use, while also providing antimicrobial protection to the user's foot.

14 Claims, 9 Drawing Sheets

(56) References Cited

U.S. PATENT DOCUMENTS

| | | | | |
|---|---|---|---|---|
| 2007/0017122 | A1* | 1/2007 | Feller | A43B 23/22 36/35 R |
| 2009/0013556 | A1* | 1/2009 | Nishiwaki | A43B 13/181 36/28 |
| 2009/0188131 | A1* | 7/2009 | Doerer | A43B 13/141 36/35 R |
| 2012/0023776 | A1* | 2/2012 | Skaja | A43B 17/026 36/43 |
| 2014/0331517 | A1* | 11/2014 | Seo | A43B 7/32 36/28 |
| 2016/0058123 | A1* | 3/2016 | Peyton | A43B 13/141 36/25 R |
| 2016/0360825 | A1* | 12/2016 | Pedersen | A43B 17/006 |
| 2017/0079379 | A1* | 3/2017 | Singh | A43B 13/40 |
| 2017/0143074 | A1* | 5/2017 | Southern | A43B 7/143 |
| 2018/0008001 | A1* | 1/2018 | Jones | A43B 7/144 |

OTHER PUBLICATIONS

[Author Unknown] Product Overview Sheet, Poron Performance, Rogers Corporation, 2018, 2 pages.

* cited by examiner

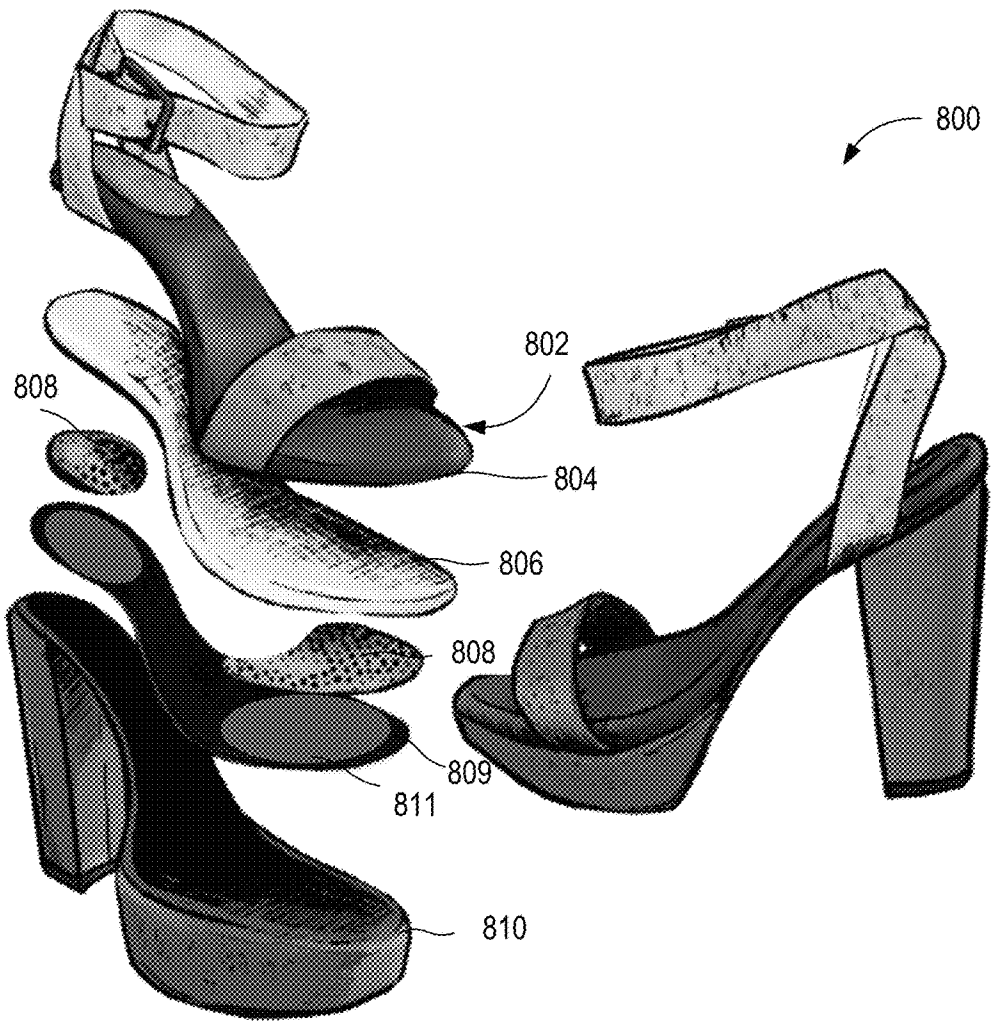
FIG. 8B
FIG. 8C
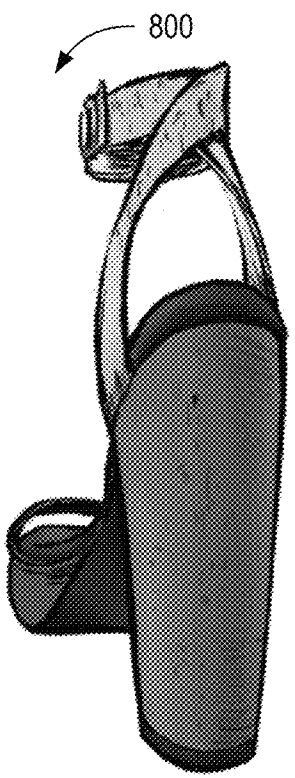
FIG. 8A

SYSTEMS AND METHODS DIRECTED TO FOOTWEAR WITH ADAPTATIONS FOR IMPROVED USABILITY

CROSS-REFERENCE TO RELATED APPLICATIONS

This application claims priority to and the benefit of U.S. Provisional Application No. 62/744,824, filed Oct. 12, 2018, entitled "SYSTEMS AND METHODS TO MAKE AND USE FOOTWEAR WITH ADAPTATIONS FOR IMPROVED USABILITY", the entire content of which is hereby expressly incorporated by reference for all purposes.

BACKGROUND

Footwear is designed to protect and comfort the foot of a user while the user performs various activities that may involve the foot coming in contact with the immediate environment. While the construction of footwear can include considerations of comfort, and protection, there are additional considerations that when implemented increasingly enhance the usability of the footwear. For example, while conventional footwear may include portions contributing to one or more sources of structural support, the integrity and functioning of these structures over time and over prolonged and/or repeated use of the footwear is an important consideration. For example, one or more portions included to provide support may deform over time and/or over repeated or prolonged use, losing the supporting property, making the footwear less usable. A need exists for footwear that includes support providing portions that have restorative properties such that any deformations of the support providing portions from prolonged use may be reduced and/or restored. Furthermore, prolonged use of footwear, and lack of release for secreted bodily fluids like perspiration from the user's foot may result in unhygienic environment within the footwear due to microbial growth within the confined spaces of the footwear. A need exits for footwear that provide antimicrobial properties accessible to the user's foot during use of the footwear.

SUMMARY

Footwear can include portions that provide structural support and/or comfort to the user. As described above, one or more portions designed to provide structural support and/or comfort, however, can get deformed over time, and/or over prolonged, repeated use. For example, footwear can include a portion and/or layer of memory foam material included to provide structural support and comfort the user's foot. The memory foam material, however, may seep and deform over time and over prolonged use, due to impact from usage. The seeping and deformation of the memory foam layer reduces and/or removes its ability to any longer provide structural support and over repeated usage the memory foam layer becomes useless as a support structure. Embodiments disclosed herein, address this shortcoming of conventional footwear by including one or more restorative layers that can be used with the support layer such as memory foam layer. The restorative layers can be configured to reduce the seeping and/or deformation of the memory foam layer and/or restore the memory foam layer close to its original, functional state.

Prolonged use of footwear may also lead to unsanitary and/or unhygienic conditions in the foot of the user due to growth and activity of microbial populations. The microbial activity may result in malodorous footwear and/or feet from prolonged use. Some embodiments of the improved footwear disclosed herein include layers and/or portions that impart antimicrobial properties to the footwear and the immediate region adjoining a user's foot during use of the improved footwear. An additional consideration associated with the inclusion of one or more layers with antimicrobial properties in an improved footwear is that the antimicrobial properties be accessible to the user's foot. Embodiments of the improved footwear disclosed herein address this consideration by including improved linings and/or portions interfacing the user's foot with the antimicrobial portions of the improved footwear such that the antimicrobial properties can act on the foot of the user as well as the other layers of the improved footwear. For example, the interfacing lining(s) and/or portions are configured to be of a predetermined porosity to allow antimicrobial properties from an underlying layer to seep and/or permeate through and reach the users foot providing antimicrobial action while also allowing release of fluids like perspiration.

Systems, devices and methods are described herein for various embodiments of an improved footwear that provides improved support, comfort, and hygiene during use. Embodiments described herein relate to systems and methods for the generation and use of footwear configured to provide improved usability and increased comfort with improved hygiene during use. Embodiments described herein relate to an improved shoe including a multi-layer midsole and/or a multi-layered insole board. Embodiments described herein also relate to a shoe including an outsole, an insole having an insole lining, a first layer disposed between the outsole and the insole, and a second layer disposed between the first layer and the outsole. The insole lining can be configured to cover an upper portion of the insole, and extend beyond an edge of the insole, first layer, and second layer, such that an end portion of the insole lining is disposed between and fixedly secured to at least one of the second layer and the outsole.

BRIEF DESCRIPTION OF THE FIGURES

FIGS. 8A, 8B, and 8C are schematic illustrations of a perspective rear view, exploded view, and a perspective, side view, respectively, of an improved footwear, according to an embodiment

DETAILED DESCRIPTION

Figure 1:
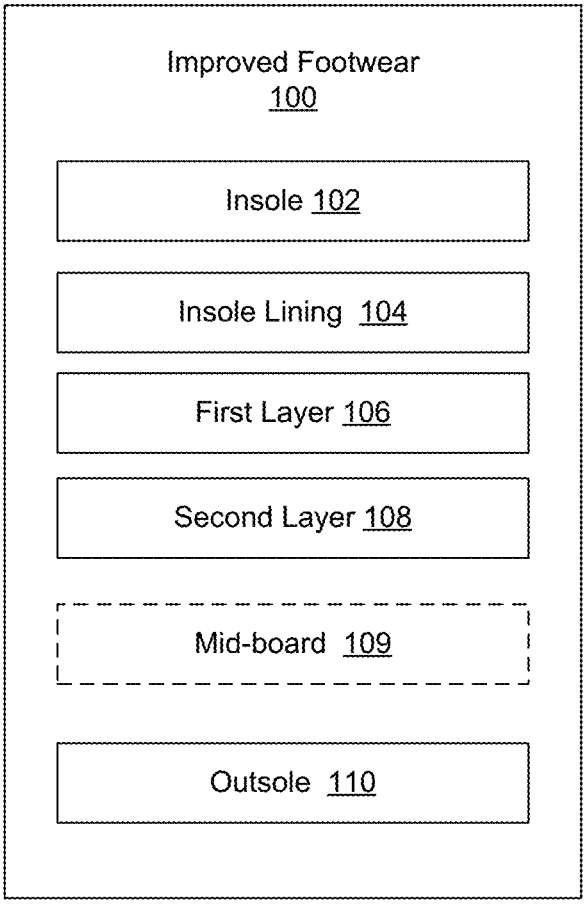
FIG. 1 is a schematic illustration of an improved footwear, according to an embodiment.

Embodiments described herein relate to systems, devices, and methods for the generation and use of an improved footwear configured to provide improved structural support, and/or improved comfort. Embodiments described herein relate to systems, devices, and methods for improved footwear having properties such as durability, shock absorbance, perspiration tolerance, and/or protection allowing reduced microbial infestation.

Some of the important considerations in the construction and configuration of footwear include interaction with the user during use, structural support provided by the components of the footwear to the user, comfort provided by the components of the footwear during use, tolerance and management of perspiration during use, and tolerance and management of potential microbial action associated with use. In some instances, the consideration of providing support and/or comfort to the user can include custom fitting to the foot shape of users for comfort, distribution of forces during use such as forces from the weight of the user, and forces generated from impact of walking/running by the user, and interaction of the various components of the footwear with each other and with the users body during use.

A need exists for incorporating efficiently several of these properties in the construction of improved footwear.

An Improved Footwear

One or more of the disclosed embodiments of improved footwear is configured to provide improved usability and increased comfort with improved hygiene during use. The disclosed embodiments relate to an improved shoe including a multi-layer midsole and/or a multi-layered insole board. Embodiments described herein also relate to a shoe including an outsole, an insole having an insole lining, a first layer disposed between the outsole and the insole, and a second layer disposed between the first layer and the outsole. The insole lining can be configured to cover an upper portion of the insole, and extend beyond an edge of the insole, first layer, and second layer, such that an end portion of the insole lining is disposed between and fixedly secured to at least one of the second layer or the outsole.

As used in this specification and the claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the words "proximal" and "distal" refer to the direction closer to and away from, respectively, a user who would place the footwear against their body. Thus, for example, the end of a footwear first touching the body of the user would be the proximal end, while the opposite end of the footwear (e.g., the end of the footwear away from the body of the user) would be the distal end of the footwear.

The embodiments described herein and/or portions thereof can include components formed of one or more parts, features, structures, etc. When referring to such components it should be understood that the components can be formed by a singular part having any number of sections, layers, regions, portions, and/or characteristics, or can be formed by multiple parts or features. For example, when referring to a structure such as a wall or chamber, the structure can be considered as a single structure with multiple portions, or multiple, distinct substructures or the like coupled to form the structure. Thus, a monolithically constructed structure can include, for example, a set of substructures. Such a set of substructures may include multiple portions that are either continuous or discontinuous from each other. A set of substructures can also be fabricated from multiple items or components that are produced separately and are later joined together (e.g., via being fused together, being sewn together, a weld, an adhesive, or any suitable method).

One or more embodiments described herein include a shoe, comprising an outsole and an insole. The insole is configured to have an insole lining, a first layer of a first material and a second layer of a second material. The first layer is disposed between the outsole and the insole, and the second layer is disposed between the first layer and the outsole. The insole lining is configured to cover an upper portion of the insole, and extend beyond an edge of the insole, first layer, and second layer, such that an end portion of the insole lining is disposed between and fixedly secured to at least one of the second layer or the outsole.

Embodiments described herein include a shoe comprising an outsole, an insole, a first layer of a first material, a second layer of a second material, and a mid-board. The first layer is disposed between the outsole and the insole. The second layer is disposed between the first layer and the outsole. The mid-board is disposed between the second layer and the outsole.

Embodiments described herein include a method of making a shoe, the method comprising covering an upper portion of an insole with an insole lining such that the insole lining extends beyond an edge of the insole, a first layer of a first material, and a second layer of a second material. The method further includes disposing an end portion of the insole lining between the second layer and an outsole. The method further includes fixedly securing the insole lining to at least one of the second layer or the outsole.

Components and Construction of an Improved Footwear

FIG. 1 shows a schematic representation of an improved footwear 100 (also referred to as "the footwear" herein), according to an embodiment. The improved footwear 100 includes an insole 102, an insole lining 104, a first layer 106, a second layer 108, an optional mid-board 109, and an outsole 110, as illustrated in FIG. 1. In some embodiments, the first layer 106 and the second layer 108 can be collectively described as a multi-layered midsole, configured to provide enhanced support and comfort while providing antimicrobial protection to a user. In some embodiments, the first layer 106, the second layer 108, and/or the mid-board 109 can be collectively described as a multi-layered midsole, configured to provide enhanced support and comfort while providing antimicrobial protection to a user.

The insole 102 is the interior most layer of the improved footwear 100, and is configured to be in contact with a user's foot. The insole 102 can be made of a suitable material to allow cross-permeability between the user's foot and the layer of the improved footwear 100 below and/or distal to the insole 102, i.e. the first layer 106. For example, in some embodiments, the insole 102 can be formed from Drirelease® nylon material. The insole 102 can be made to conform to any suitable shape in consideration with the shape of the improved footwear 100 and the shape and size of foot of a potential user. The insole 102 can include portions that come in contact with the various regions of the user's foot such as the toe, heel arch, etc. The insole 102 can be formed to have a specific thickness to best suit the needs of the improved footwear 100. In some embodiments, the thickness of the insole 102 can be uniform while in other embodiments the thickness of the insole 102 can be varied over the various portions of the insole configured to come in contact with the various regions of the user's foot.

In some instances, the insole 102 can be configured to optimally suit users with different gait and/or posture. The insole 102 can be configured to distribute forces from the weight of the user and forces from impact during walking and/or running, by providing high shock absorption, for example. In some embodiments, the insole 102 can include portions specifically designed to provide increased contact and support to specific regions of the user's foot. For example, portions of the insole 102 that are in contact with the heel of the user can be configured differently in terms of various properties such as thickness, material density, porosity, absorptiveness, permeability to fluid flow, flexibility, etc., from the portions of the insole 102 that come in contact with the toe and/or arch of the user's foot. In some instances, the insole 102 can be configured to relieve and/or reduce pain brought on by a joint or health issue. For example, the insole 102 can in some instances be specifically configured to address and/or relieve pain from health conditions like metatarsalgia, mid tarsal arthritis, plantar fasciitis, mid tarsal arthritis, and plantar callous or the like. As an example, the insole 102 can be configured to have additional thickness in specific portions adjacent to the plantar fascia to provide additional support to relieve pain from plantar fasciitis. In some instances, portions of the insole 102 can be suitably shaped to provide optimal support and/or comfort to the user. As an example, the insole 102 can include portions configured to provide additional cushioning to the mid tarsal areas of the foot of users suffering from mid-tarsal arthritis. In some instances, the insole 102 can be configured to provide increased support to certain portions of the user's foot in consideration with other portions of the footwear 100. For example, the configuration of the insole 102 can be adapted in some instances to suit high heeled shoes while in other instances to suit flat heeled shoes. In some embodiments, the insole 102 can be configured to provide additional support to portions of a user's foot based on the configuration of other portions of the footwear. For example, the configuration of the insole 102 can be adapted to provide additional support to an arch portion of a user's foot in consideration to a tapered configuration of the high heel of the footwear.

The insole lining 104 is configured to cover the insole 102 and provide an interface between the insole 102 and the user's foot. The insole lining 104 can be made of any material with a suitable porosity to provide permeability between the insole 102 and underlying layers of the footwear, allowing access to antimicrobial properties from underlying layers of the improved footwear 100. For example, the insole lining 104 can be made from material such as a Dri-Fit® lining or a nylon lining. The insole lining 104 is configured to be porous allowing permeability between the user's foot and the first layer 106 that lies below the insole 102 of the improved footwear 100, as illustrated in FIG. 1. In some embodiments, the insole lining 104 is coupled and/or fastened to the other layers of the improved footwear 100 by extending around and/or beyond an edge of the insole 102, the first layer 106, and the second layer 108, and being tucked and/or secured between the second layer 108 and the outsole 110 of the footwear 100.

The first layer 106 of the footwear 100 lies below (or distal to) and/or adjacent to the insole 102 and is in physical contact with the insole lining 104. The first layer 106 is made from any suitable memory foam material and can be cut or otherwise formed into to any desired size and shape. For example, the first layer 106 can be formed using a "viscoelastic" polyurethane material including additional components to suitably modulate the viscosity and/or density. As another example, the first layer 106 can be made using a Poron memory foam material, polyurethane foam material, and/or low-resilience polyurethane foam (LRPu) material, and made to conform to a specific shape. The first layer 106 can include foam bubbles and/or 'cells' that are open, and configured to form a matrix through which fluids such as air, perspiration can move and/or permeate. The cell matrix can allow cross permeation of potential antimicrobial properties of an underlying layer such as the first layer 206. The cell matrix can also be configured to allow dispersion of any secreted perspiration, increasing ventilation of the user's foot during use.

As described, the first layer 106 can be made to conform to any suitable shape in consideration with the shape of the improved footwear 100 and the shape of foot of a potential user. As described with reference to the insole 102, the first layer 104 can include portions that come in contact with the various regions of the user's foot such as the toe, heel arch, etc. In some embodiments, the first layer 106 can be uniformly configured over all portions, for example having a uniform thickness.

The first layer 106 can be formed from and/or include one or a combination of materials, and those material(s) can have various size and material properties (e.g., thickness, density, deflection for a given load, resilience, shock absorption, and the like). Such properties can be selected to provide sufficient support, stability, and comfort to the user, as described in further detail herein, as well as aesthetic appeal (e.g., the first layer may have a thickness threshold beyond which the footwear 100 is sufficiently aesthetically pleasing). In some embodiments, the first layer can be made of a foam having a thickness of about 3 mm and/or a density of about 27 $kg/m^3$, imparting a shock absorption of about 6 to about 7 kN (e.g., about 6.8 kN). An example of such a material is Poron® foam.

In some other embodiments, the first layer 106 can be made of Poron Performance® foam and can have a thickness of about ⅛ inch. In some embodiments, the first layer 106 can have a relatively slow re-bounce time to complement and/or enhance the properties provided by the second layer 108, as described in further detail herein. Similarly stated, the material for the first layer 106 can be chosen to suit the properties of the second layer 108 to better absorb the impact of the ground during use of the footwear 100.

In some embodiments, the first layer 106 can be made of a softer foam (e.g., Poron Harmony® foam or Poron Cadence® foam) and can have a thickness of about ⅛ inch. The softer foam may be selected such that it has a greater ability to mold to a user's foot and provide a custom wearable feel during use of the footwear 100. In some instances, the softer foam material may be chosen based on one or more properties of the footwear 100, for example the heel height desired, and/or the shape of the footwear 100, and/or the intended use of the footwear 100, etc. For example, the Poron Harmony® foam may be selected to form the first layer 106 if the footwear 100 is configured to have high heels. As another example, in some instances, the Poron Cadence® foam may be selected to form the first layer 106 to form a footwear 100 intended to have a desired softness and used for orthopedic purposes.

In some embodiments, the first layer 106 can have the same size and/or shape of the insole 104 and/or the second layer 108. In some embodiments, the size and/or shape of the first layer 106 can be changed based on the shape of the footwear 100. In some other embodiments, the first layer 106 can have a smaller size compared to the insole 104 and/or the second layer 108, such that the width of the first layer 106 is reduced at one or more portions along the length of the first layer 106, depending on the width of the footwear 100 at the one or more portions. For example, the width of the first layer 106 can be approximately 1-1.5 cm lesser than the width of the insole 104 and/or the second layer 108, depending on the width of the footwear 100. In some instances, the first layer 106 can be configured to be of a reduced size (e.g., 1-1.5 cm lesser width) than the second layer 108, to aid in a lasting process used to manufacture the footwear 100. For example, the first layer 106 can be configured to have the edges shaved down or filed down in thickness such that the first layer 106 has a lesser surface area of a particular thickness than the second layer 108 by reducing the radial width along the circumference of the footwear 100 (e.g., by shaving or filing 1-1.5 cm of width on one or both sides of the footwear 100) and allow an overall slimmer appearance of the footwear 100. In some embodiments, the reduction of width of the first layer 106 can be implemented along the entire circumference of the footwear 100. In some embodiments, the reduction of width of the first layer 106 can be implemented in only some portions of the footwear 100 (e.g., the ball or the heel portion). In some instances, the reduction of the width of the first layer 100 can be implemented in one or more portions of the footwear 100 based on the overall width of the footwear 100 at those portions. In some instances, the reduction of the width of the first layer 100 can be implemented to reduce thickness of the one or more layers of the footwear 100 such that lasting process can be carried using a machine (i.e., the layers to be lasted are not too thick that they have to be manually lasted, which may incur additional manufacturing costs).

As described above, in some embodiments, the various portions of the first layer 106 can be custom-configured to meet specific needs of each portion coming in contact with the various regions of the user's foot. For example, the heel portion of the first layer 106 may be configured to have increased thickness compared to the remaining portion of the first layer 106. In some embodiments, the heel portion may have an increased density compared to the remaining portions of the first layer 106 (e.g., the mid-tarsal portion, the arch portion, and/or the toe portion, etc.) in consideration with the shape of the footwear 100 and/or the requirements of a potential user. As another example, the arch portion of the first layer 106 can have increased thickness and density compared to the remaining portions of the first layer 106, when used to form a footwear with a high and tapered heel.

The second layer 108 of the footwear 100 lies below (or distal to) and/or adjacent to the first layer 106 and is in physical contact with the first layer 106. In some embodiments, the second layer 108 can be coupled and/or fused together with the first layer 106. In an example method, the first layer 106 and the second layer 108 can be precision cut to a predetermined shape, using a machine and/or by hand, and compressed together as one and fused together by any suitable means. Once fused together the edges can be sanded and/or otherwise finished to obtain a smooth trim before being wrapped by the insole lining 104 (e.g., nylon dri-fit).

In some embodiments, the second layer 108 can be formed from and/or include shock absorbing gel material, and made to conform to a suitable thickness and shape in consideration with the shape of the footwear 100 and the shape of the user's foot. In some embodiments, the second layer 108 can be formed from and/or include at least a visco-elastic polymer, such as, for example, a Sorbothane® thermoset, polyether-based, polyurethane material The material for the second layer 108 can be selected based on its properties to combine shock absorption, form memory, vibration damping and/or vibration isolation characteristics. The material can be selected to be an effective acoustic damper and absorber, also having a sufficiently long fatigue life. Some other properties of the material selected to form the second layer 108 can include having a low creep rate (e.g. Sorbothane® can have lower creep rate compared to other polymers like rubber, neoprene, silicone, etc.), a superior damping coefficient over a very wide temperature range, sustained shock absorption efficiently for millions of cycles without the need for metal springs to return the system to its equilibrium position after absorbing a shock.

For example, in some embodiments, the second layer 108 can be made from Sorbothane® Gel, Duro 50 of thickness ⅛ inch. An example Sorbothane® material used for the second layer 106 can have a specific gravity of about 1.310 and a density of about 81.78 lb/fe, a tensile strength (at 100% strain) of about 23 psi. For example, a Sorbothane® material configured to form the second layer 108 can be a visco-elastic polymer with properties of viscous solutions (liquids) and elastic solids.

Similar to as described with reference to the first layer 106, a thickness of the second layer 108, in some embodiments, can be determined based on requirements such as structural support, perceived hardness of the outsole 110, and the aesthetic appeal of the footwear. For example, in some instances, a choice of a different type of Sorbothane® and/or other polymer material or a choice of a thicker material may lead to decreased structural support and/or unappealing appearance of the footwear. As another example, a choice of a higher density Sorbothane® gel to form the second layer 108 may result in a higher perceived hardness and/or bulkiness of the footwear during use. In some instances, the Sorbothane® gel material for the second layer 108 can be chosen for its properties that complement and/or enhance the properties bestowed by the first layer 106, as described in further detail herein.

The second layer 108 can be fixed and/or adhered to the first layer 106 by any suitable means. In some embodiments, for example, an adhesive can be applied to the first layer 106 and/or the second layer 108 to ensure that the layers are sufficiently fixedly coupled together. In some embodiments, for example, to avoid the additional material expense and additional labor of adding an adhesive to one or more of the layers, the material of the first layer 106 and/or the second layer 108 may be configured to provide sufficient adherence to the other layer. More specifically, for example, in instances in which the second layer 108 is formed from and/or includes a gel (such as a Sorbothane® gel, or the like), and natural adhesive and/or stickiness of the gel can be used and/or relied on to adhere the first layer 106 to the second layer 108. As described above, the second layer 108 can be precision cut to a predetermined shape, to match and/or complement the cut of the first layer 106, using a machine and/or by hand. In some instances, the first and second layers 106, 108 can be compressed together as one and fused together to, for example, effectively form a unibody insole board. Once fused together the edges can be sanded and/or otherwise finished to obtain a smooth trim before being wrapped by the insole lining 104 (e.g. nylon Dri-fit®). The amount of compression of the first layer 106 and the second layer 108 can be predetermined based on the type of footwear to be made. For example, in some instances, where a footwear with a pointier toe is to be made, the two layers 106, 108 may be compressed more relative to an open-toe footwear.

As described with reference to the first layer 106, the second layer 108 can be configured to include portions that lay below and/or come in indirect contact with the various regions of the user's foot such as the toe, heel arch, etc. In some embodiments, the second layer 108 can be uniformly configured over all portions, for example having a uniform thickness of ⅛ inch. In some other embodiments, the various portions of the second layer 108 can be individually configured to meet specific properties such as thickness, density, gel porosity, etc. so that the various regions of the user's foot with which the portions come in contact receive varying degrees of support. For example, the arch portion of the second layer 106 may be configured to have increased thickness, and/or increased gel porosity with respect to the heel portion of the footwear 100 and/or the anatomical requirements of a potential user's foot. In some embodiments, the second layer 108 can be configured to reinforce and/or provide support over one or more portions of a user's foot (including one or more pressure points of the user's foot) and mold with the user's foot (at those portions) over time and/over repeated use.

In some embodiments, the second layer 108 can be configured to cover the entire surface area of the footwear 100 (also referred to herein as the "non-isolated configuration"). That is, the second layer 108 can extend over a surface area defined by the outsole 110 and/or a surface area defined by the insole 102 of the footwear 100. In some embodiments, the second layer 108 can extend over smaller isolated portions of the surface area defined by the insole 102 and/or a surface area defined by the outsole 110 of the footwear 100 (also referred to herein as the "isolated configuration"). For example, in some embodiments, the second layer 108 can extend over specific regions that may lie next to pressure points of a user's foot during use. For example, in some embodiments, the second layer 108 can extend over portions adjoining the ball and/or heel portions of the footwear 100. In some embodiments, the second layer 108 can be configured in the isolated configuration to have a reduced thickness of the midsole (compared to a thickness of midsole when the footwear 100 is in a non-isolated configuration with the second layer 108 extending over the surface area defined by the insole 102 and/or the outsole 110) of a footwear 100 and/or to meet a requirement of a sleek appearance of the footwear 100 defined by a width of the footwear 100 that is narrower in the isolated configuration of the second layer 108 compared to a width of the footwear 100 when the second layer is in the non-isolated configuration. In some embodiments, a footwear 100 in the isolated configuration can include the second layer 108 that extends over regions that lie next to areas (e.g., the ball, heel, arch of a user's foot, etc.,) where a user's foot may exert forces on the footwear 100, during use of the footwear 100. The second layer 108 in the isolated and/or the non-isolated configuration can be formed to distribute forces exerted by the user's foot on the one or more regions of the footwear 100 such that the user can avoid experiencing pain during extended use of the footwear 100, which may otherwise be incurred.

In some embodiments, the footwear 100 can include an optional mid-board 109, as indicated by a dashed line in FIG. 1. In some embodiments, the mid-board 109 can made of a layer of cellulosic material, such as, for example, a custom defined Bartoli® Mid-Board. In some embodiments, the mid-board 109 can be generated by bonding using binders and under extremely high temperatures. In some embodiments, the mid-board 109 can be molded to have a predetermined shape with the base surface of the mid-board 109 including one or more indentations. The one or more indentations defined in the base surface can be configured to house or lie adjoining specific portions of the second layer 108. The one or more indentations in the mid-board 109 can be configured to mold to the adjoining second layer 108 (e.g., allow the Sorbothane® gel thickness to sit into the indentation) with the first layer 106 overlying the indentation. In some embodiments of the footwear 100 the second layer 108 may be implemented in an isolated configuration such that the one or more indentations in the mid-board 109 and the overlaying first layer 106 define one or more pockets and/or cavities that can house isolated portions of the second layer 108 in a snug configuration without any lateral movement. In some instances, having the overlaying first layer 106 above the surface of the isolated portions of the second layer 108 can give the footwear 100 a slimmer appearance. In some embodiments, a footwear 100 can be configured such that the second layer 108 is implemented in a non-isolated configuration such that the one or more indentations in the mid-board 109 and the overlaying first layer 106 define a contour over the surface of the footwear 100 that can better interface with a user's foot during use and mold to the users foot with repeated use. The contour formation by the one or more indentations defined on the mid-board 109 can aid in a non-isolated second layer 108 to better support a user's foot along with the adjoining first layer 106 and limit and/or prevent lateral movement of the one or more layers and/or relative lateral movement between the layers.

In some embodiments, the shape and/or material of the mid-board 109 can be selected to achieve a lightweight footwear 100 and to increase wearability of the footwear 100. The mid-board 109, for example, can be formed of a light weight material such as cellulose and/or carbon fiber. In some embodiments, the mid-board 109 can be solidly made with material. In some other embodiments the mid-board 109 can be a structure including one or more hollowed portions (or portions that include one or more defined cavities for example on the surface distal to the users foot during use and/or the surface closer to the outsole 110 of the footwear 100) that have the structural integrity to provide the support needed while reducing weight of the footwear 100. In some embodiments, the mid-board 109 can be formed using carbon fiber to allow lightness of the mid-board 109 and/or the footwear 100.

The outsole 110 of the footwear 100 is the layer configured to be in direct contact with the ground when in use. The outsole 110 can be made using any suitable durable material such as leather, resin, rubber, and/or synthetic materials like polyurethane. The outsole 110 can be formed from a single piece of material or can be formed from the assembly of separate portions that may correspond to different regions of the user's foot. In some embodiments, the outsole 110 can include suitable adaptations to meet specific needs such as improved traction, increased heel height, different forms of heel (e.g. block heels, tapered heels, etc.).

Figure 2A:
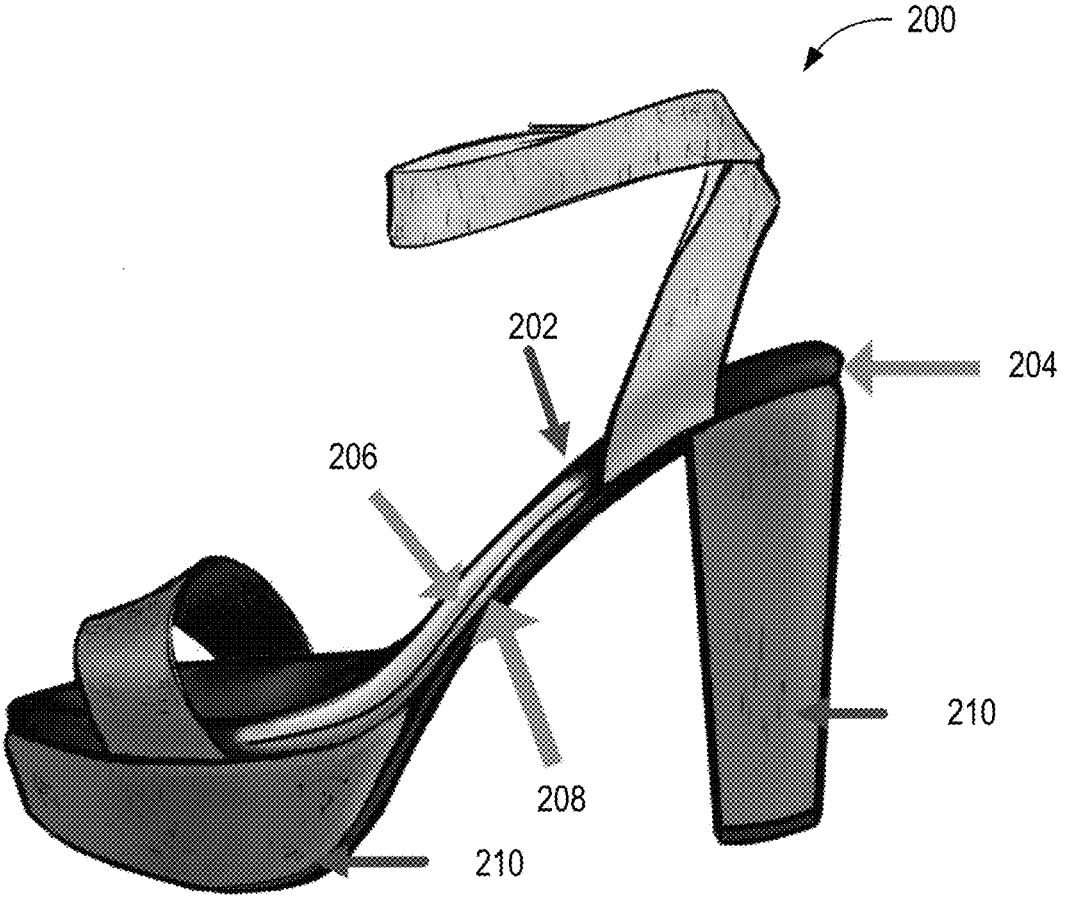
FIG. 2A is a schematic illustrations of a side view of an example improved footwear, indicating the various structural components of the improved footwear, according to an embodiment.

FIG. 2A illustrates a side view of an example improved footwear 200, according to an embodiment. The footwear 200 can be substantially similar in structure and/or function to the footwear 100 described above. For example, the footwear 200 includes an insole 202 with an insole lining 204, a first layer 206, a second layer 208, and an outsole 210. As illustrated, in this embodiment, the outsole 210 includes a heel. Similar to as described with reference to the footwear 100, the first layer 206 can be a memory foam layer that has anti-microbial properties. The insole 202, and the insole lining 204 can be made of porous material permeable to sweat and/or other bodily fluid(s) that may be secreted by a user's foot during use of the footwear 200. The insole 202 and the insole lining 204, by virtue of their porous, permeable nature, can be configured to allow passage of fluids (e.g. air, perspiration etc.,) between the foot of the user and the first layer 206. The first layer 206 can having antimicrobial properties (e.g. include antimicrobial nanoparticles) that can be transmitted and/or carried by the fluids via the insole 202 and the insole lining 204 to the user's foot. The permeated antimicrobial properties can inhibit bacterial growth and/or proliferation reducing any malodorous buildup of bacterial activity in the footwear.

The first layer 206 is configured to provide optimal support to the foot of the user, and be suitably compressible conforming to the contours of the user's foot. The second layer 208 has suitable elastic gel properties such that while the first layer 206 may be increasingly compressed by forces (e.g. impact forces during walking and/or from the weight of the user) the elastic nature of the second layer 208 can ensure shape restoration of the first layer 206, allowing continued support and comfort over longer periods of time. For example, the second layer 208 can be made of a thermoplastic elastomeric material configured to have suitable physical properties like density, tensile strength, stress and strain resistance, etc., such that it retains a predetermined shape, even when exposed to prolonged and/or focused forces of impact. The improved footwear 200 can be configured such that the second layer 208 lies adjacent to and in substantially full contact with the first layer 206. Thus any deformation of the first layer 206 can be corrected by restorative forces exerted on the first layer 206 by the second layer 208, to revert the first layer 206 to its original shape and/or configuration. As an example, the first layer 206 made of memory foam material may seep over time and over prolonged use thereby losing its shape. A second layer 208 made of thermoplastic gel and/or silicone gel configured to lie adjacent to the memory foam material of the first layer 206 can restore the memory foam layer avoiding seepage over repeated use. The gel material of the second layer 208 can also be configured to provide shock absorbing properties and distribute the forces imparted on the footwear by the user and/or by impact from the ground during usage.

Figure 2B:
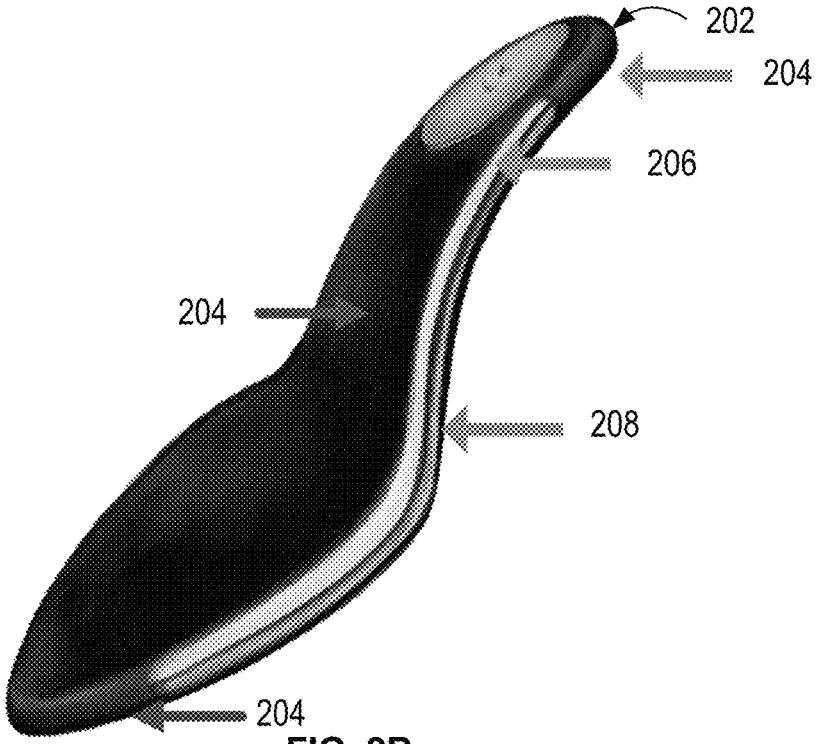
FIG. 2B is a schematic illustrations of a perspective view of a portion of the improved footwear of FIG. 2A.

In some embodiments of the footwear 200, the insole lining 204 can be coupled to the remaining layers such that the insole 202, the first layer 206 and the second layer 208 can be fastened together to form a unibody insole board FIG. 2B illustrates the unibody insole board of such a configuration of the improved footwear 200. The insole lining 204, in this example, is shown to be disposed over the insole 202 at the proximal end and stretched over the side portions of the first layer 206, and stretched over portions of the second layer 208 at the distal end. The overhanging portions of the insole lining 204 disposed over the second layer 208 can be tucked under the second layer 208 before fastening the insole board to the outsole 210. In some embodiments, the insole lining 204 can be disposed to cover the entire side portions of the first and second layers. The illustrations in FIGS. 2A and 2B show cut outs exposing the first layer 206 and the second layer 208 sandwiched between the insole 202 and the outsole 210. The insole board with the insole lining 204 disposed over the insole 202, the first layer 206 and the second layer 208, can be fastened to the outsole 210 using any suitable method such as using adhesives, being sewn together, etc.

Figure 3:
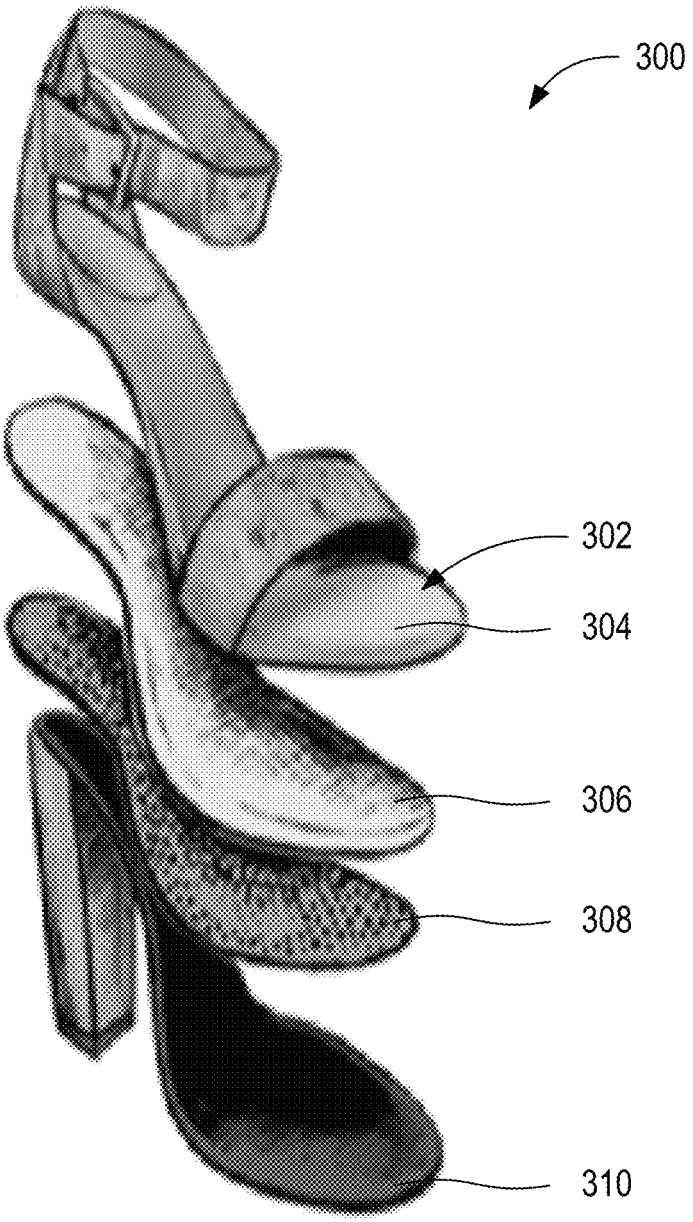
FIG. 3 is a schematic illustration of an exploded view of an improved footwear, showing the structural components and their arrangement, according to an embodiment.

FIG. 3 illustrates an exploded view of an improved footwear 300, according to an embodiment. The footwear 300 can be substantially similar to the footwear 100 and 200 described above, in structure and/or function. The component layers of the footwear 300 include an insole 302 with an insole lining 304, a first layer (e.g., a memory foam layer) 306, a second layer (e.g., a gel layer) 308, and an outsole 310. As shown in FIG. 3 the footwear 300 can be open toed with the outsole 310 including a heel. The footwear 300 can include any suitable form of fastener to be used to fasten the footwear to the foot of the user. As described above, the first layer 306 and the second layer 308 can be fused together. In some embodiments, the insole lining 304 and/or the insole 302 can be configured to be of a larger surface area than the other layers, and can be stretched over the first layer 306 and the second layer 308 with border portions of the insole lining 304 and/or the insole 302 inserted between the second layer 308 and the outsole 310 before fastening the two together.

Additional Example Embodiments

Figure 4C:
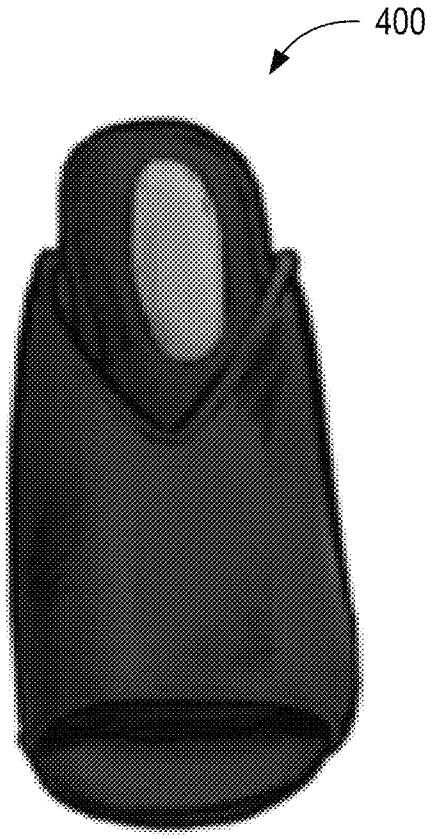
FIGS. 4A, 4B, and 4C are schematic illustrations of a rear view, exploded view, and a front view, respectively, of an improved footwear, according to an embodiment.
Figure 4B:
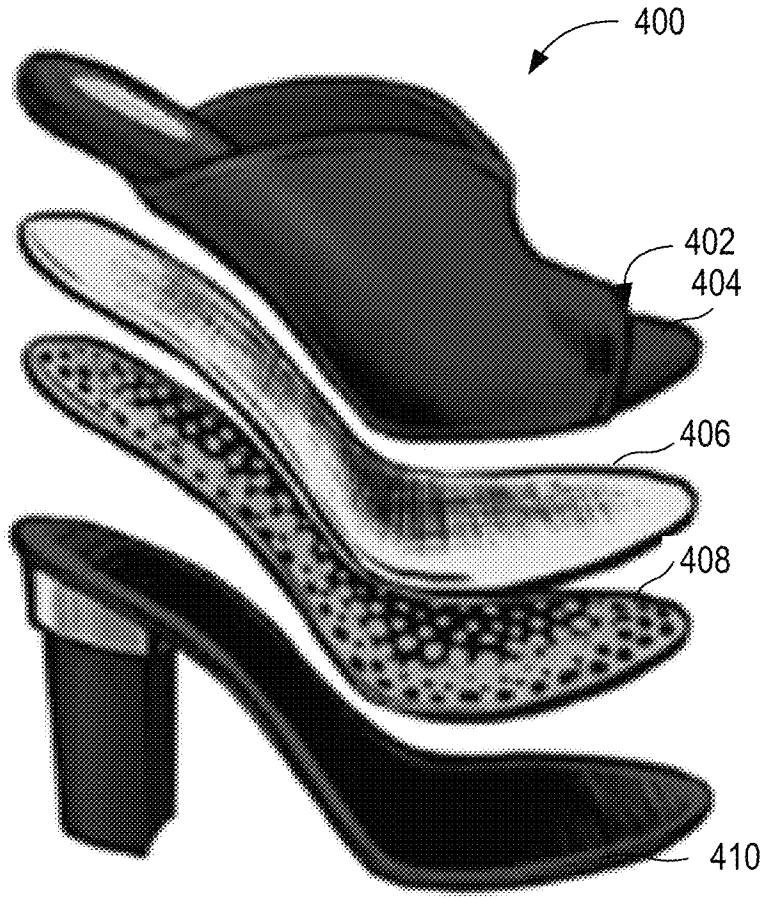
Figure 4A:
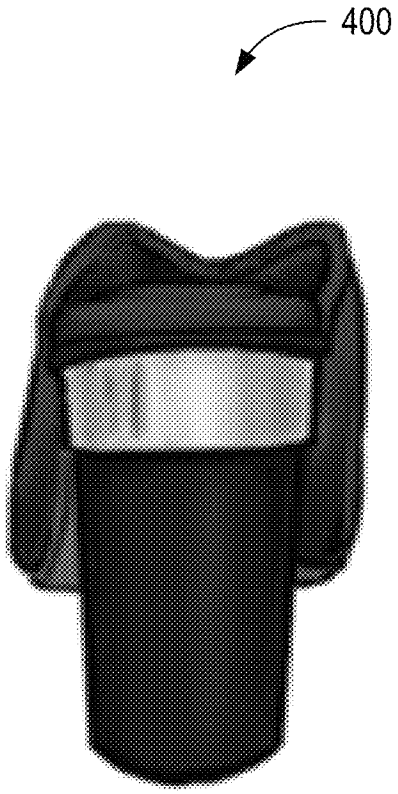

FIGS. 4A-4C illustrate a rear view, an exploded side view and a front view, respectively, of an example improved footwear 400, according to an embodiment. The footwear 400 can be substantially similar, in structure and/or function, to the improved footwear 100, 200, and 300 described above. The illustrated example footwear 400 is an open toe shoe with a high heeled outsole 410.

Figure 5C:
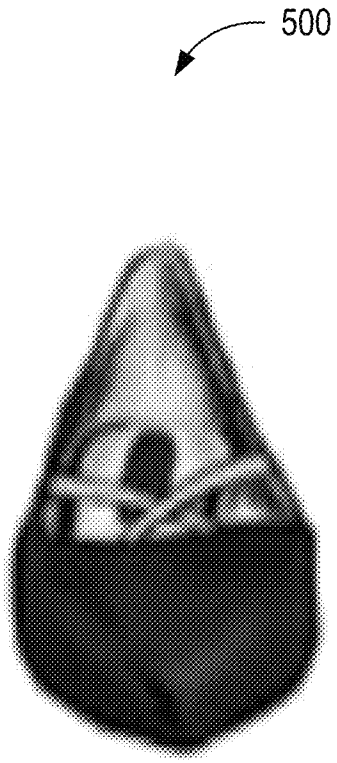
FIGS. 5A, 5B, and 5C are schematic illustrations of a top view, exploded view, and a front view, respectively, of an improved footwear, according to an embodiment.
Figure 5B:
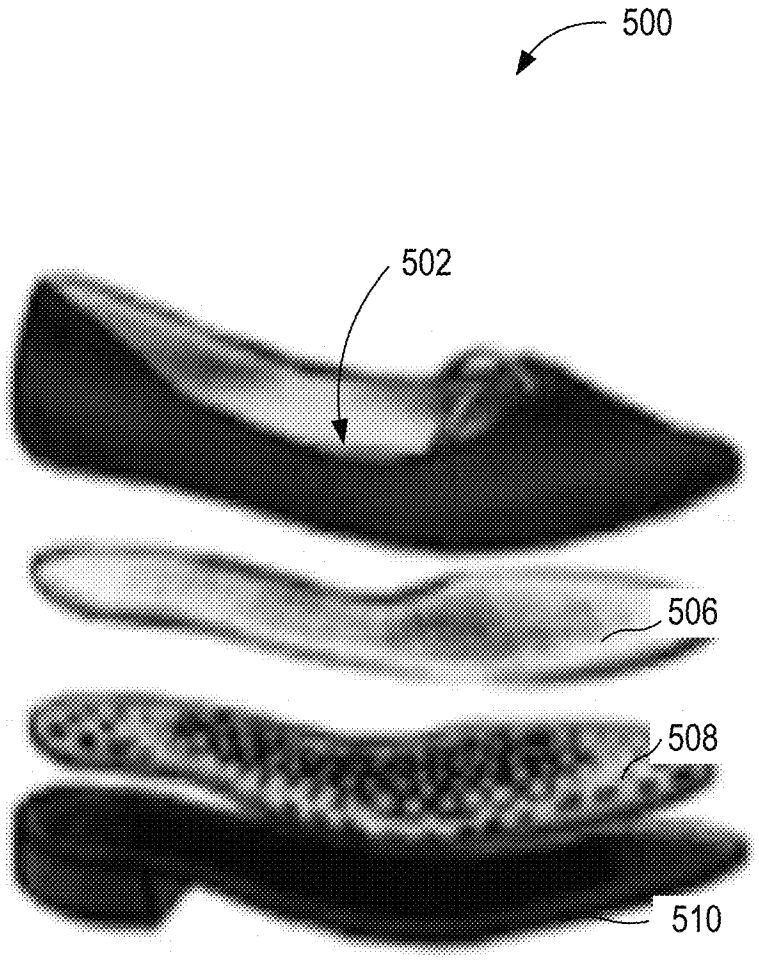
Figure 5A:
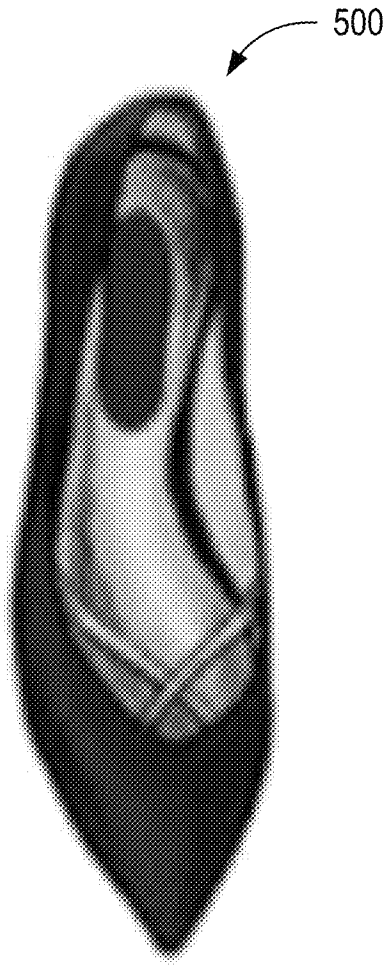

FIGS. 5A-5C illustrate a top view, an exploded side view and a front view, respectively, of an example improved footwear 500, according to an embodiment. The footwear 500 can be substantially similar to the improved footwear 100, 200, 300, and 400 described above, in structure and/or function. The illustrated example footwear 500 is a closed toe shoe with a relatively flat heeled outsole 510, compared to the heels of the embodiments 200, 300, and/or 400 described above.

Figure 6C:
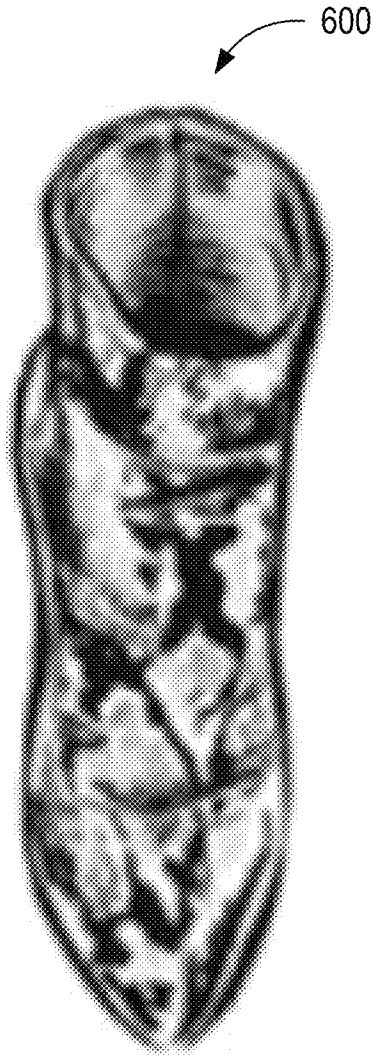
FIGS. 6A, 6B, and 6C are schematic illustrations of a perspective, rear view, exploded-side view, and a top view, respectively, of an improved footwear, according to an embodiment.
Figure 6B:
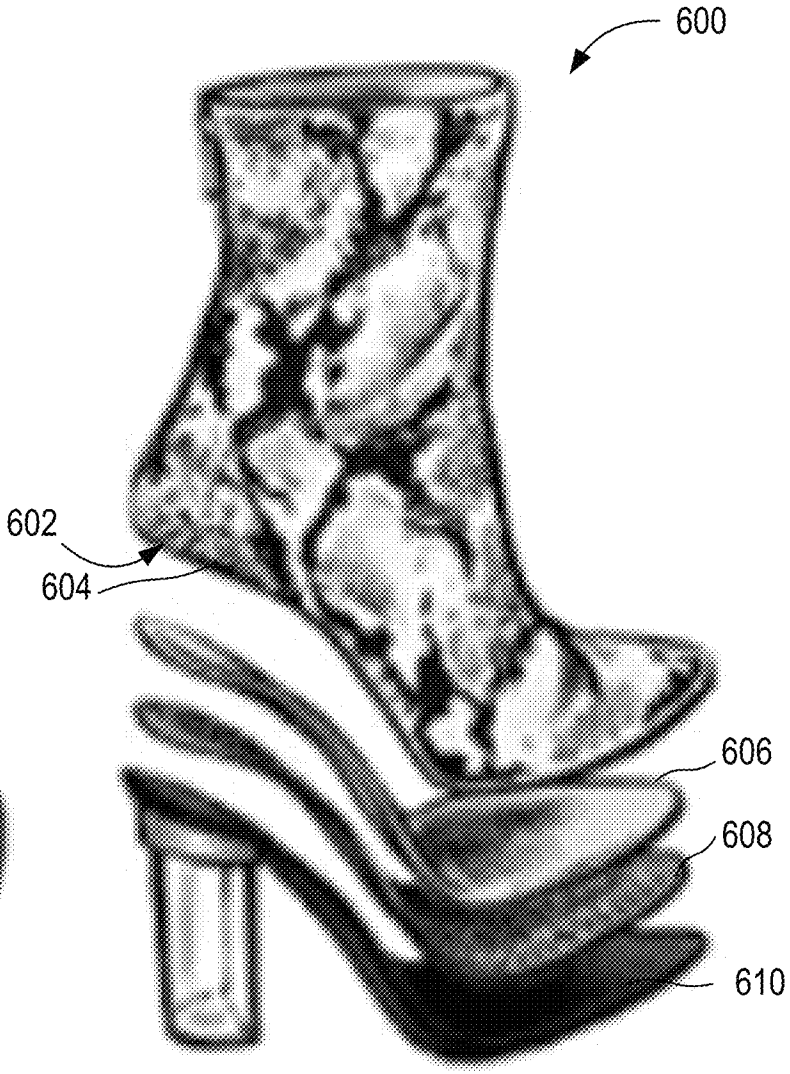
Figure 6A:
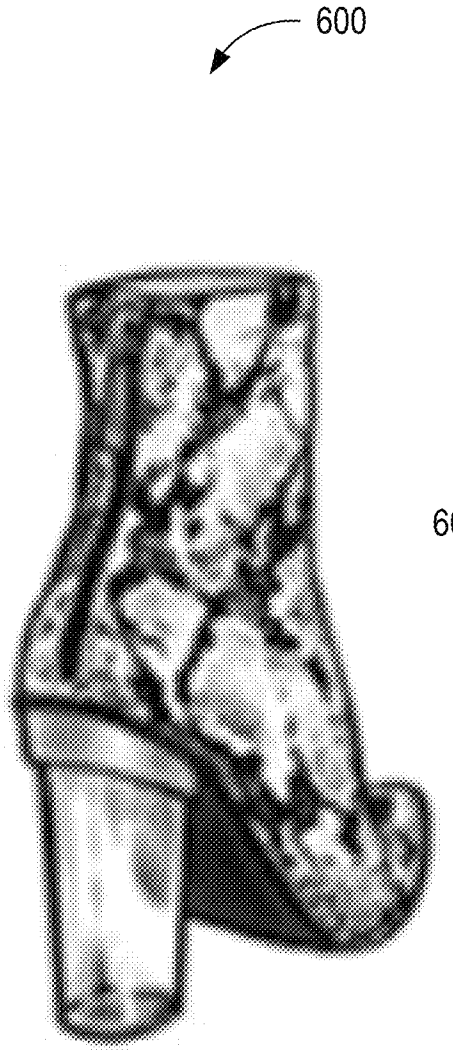

FIGS. 6A-6C illustrate a perspective rear view, an exploded side view and a perspective view from the front, respectively, of an example improved footwear 600, according to an embodiment. The footwear 600 can be substantially similar to the improved footwear 100, 200, 300, 400, and 500 described above, in structure and/or function. The illustrated example footwear 600 is a closed toe boot with a high heeled outsole 610.

Figure 7C:
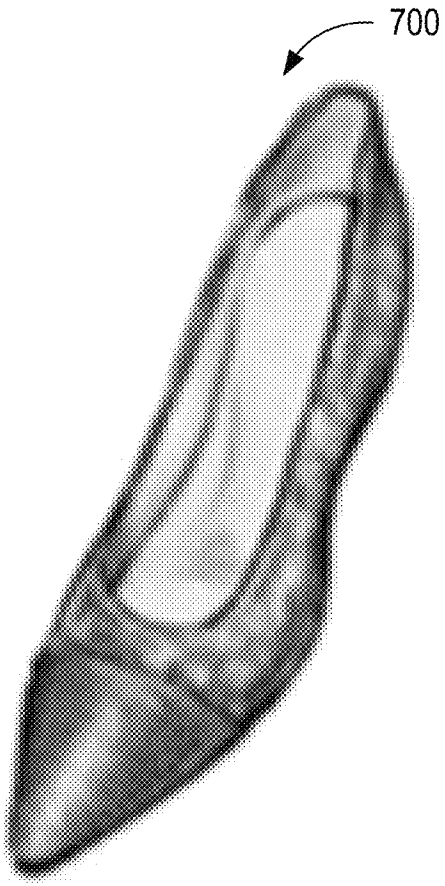
FIGS. 7A, 7B, and 7C are schematic illustrations of a perspective rear view, exploded view, and a perspective, top view, respectively, of an improved footwear, according to an embodiment
Figure 7B:
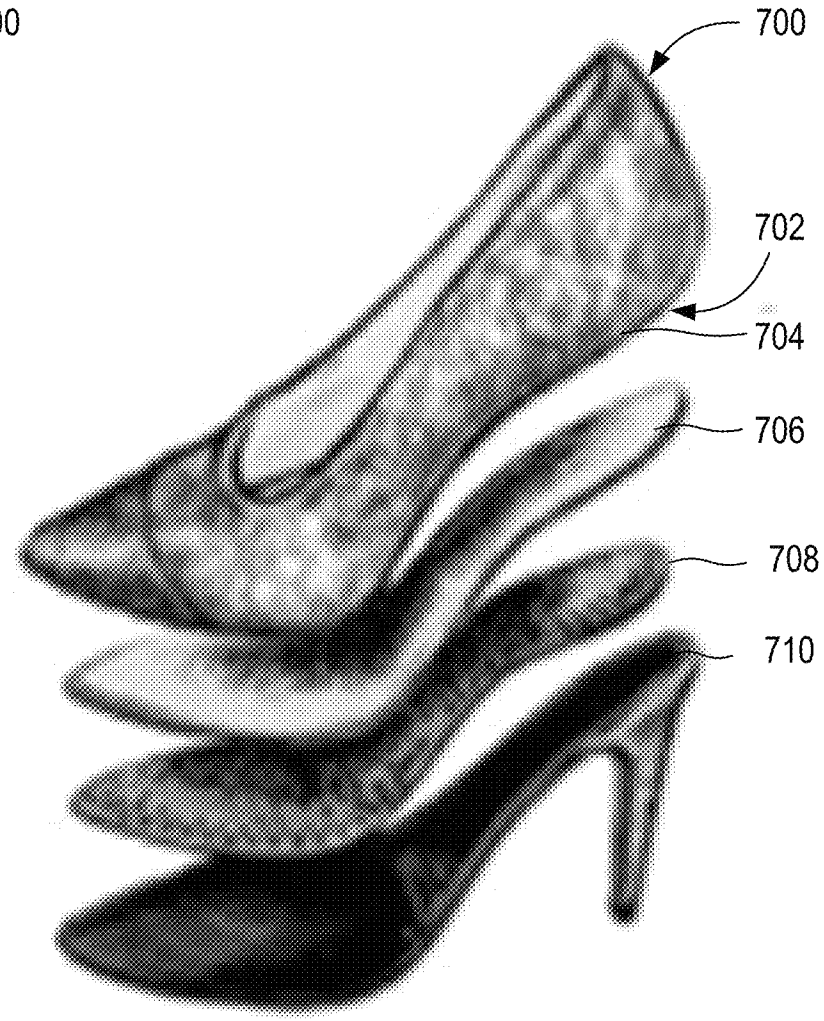
Figure 7A:
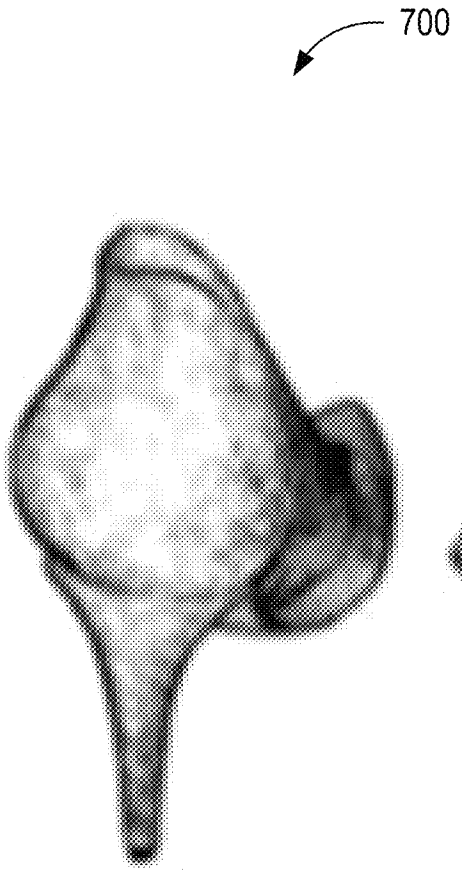

FIGS. 7A-7C illustrate a perspective rear view, an exploded side view and a perspective front view, respectively, of an example improved footwear 700, according to an embodiment. The footwear 700 can be substantially similar to the improved footwear 100, 200, 300, 400, 500, and 600 described above, in structure and/or function. The illustrated example footwear 700 is a closed-toe boot with a high heeled outsole 710, the heel being tapered.

FIGS. 8A-8C illustrate a perspective rear view, a perspective exploded side view and a side view, respectively, of an example improved footwear 800, according to an embodiment. The footwear 800 can be substantially similar to the improved footwear 100, 200, 300, 400, 500, 600 and/or 700 described above, in structure and/or function. Thus, portions of the footwear 800 are not described in further detail herein. As shown in FIG. 8B, the footwear 800 includes an insole 802, an insole lining 804, a first layer 806, a second layer 808, a mid-board 809 and an outsole 810. In some instances, the insole 802 can be porous and the insole lining 804 can be a material that is breathable to allow access between the user's foot and the first layer 806 (foam) helping movement of moisture from the user's foot (an example breathable material is Dri Fit® (Nike®)). In some embodiments, the first layer 806 can be a foam layer using a memory foam material and/or polyurethane foam material, and/or low-resilience polyurethane foam (LRPu) material, as described with reference to first layer 106 and made to conform to a specific shape. For example, the first layer can be formed from Poron® Foam with a about 1 cm to an about 1.5 cm rim filed down around the edge to eliminate thickness and machine lasting issues, as described previously. The second layer 808 of the footwear 800 can be substantially similar to the second layer 108 described with reference to the footwear 100. As shown, the second layer 808 of the footwear 800 is in an isolated configuration, extending over the ball portion, arch portion, and/or the heel portion of the footwear 800. The mid-board 809 can be substantially similar to the mid-board 109 described with reference to the footwear 100. As shown in FIG. 8B, the mid-board 809 is configured to include one or more indentations 811 defined to at least partially house the isolated portions of the second layer 808 adjoining the indented portions of the mid-board 809 as described with reference to the mid-board 109 and the second layer 108 above. The one or more indentations (and/or the contours of the indentations) defined on the mid-board 809 can be configured to limit and/or prevent lateral movement of the one or more layers (e.g., isolated portions of the second layer 808), and/or relative lateral movement between the layers (e.g., between the mid-board 809 and the isolated portions of the second layer 808 and/or between the first layer 806 and the isolated portions of the second layer 808). The illustrated example footwear 800 is an open-toe footwear with a high heeled outsole 810, the heel being only partially tapered.

Figure 9:
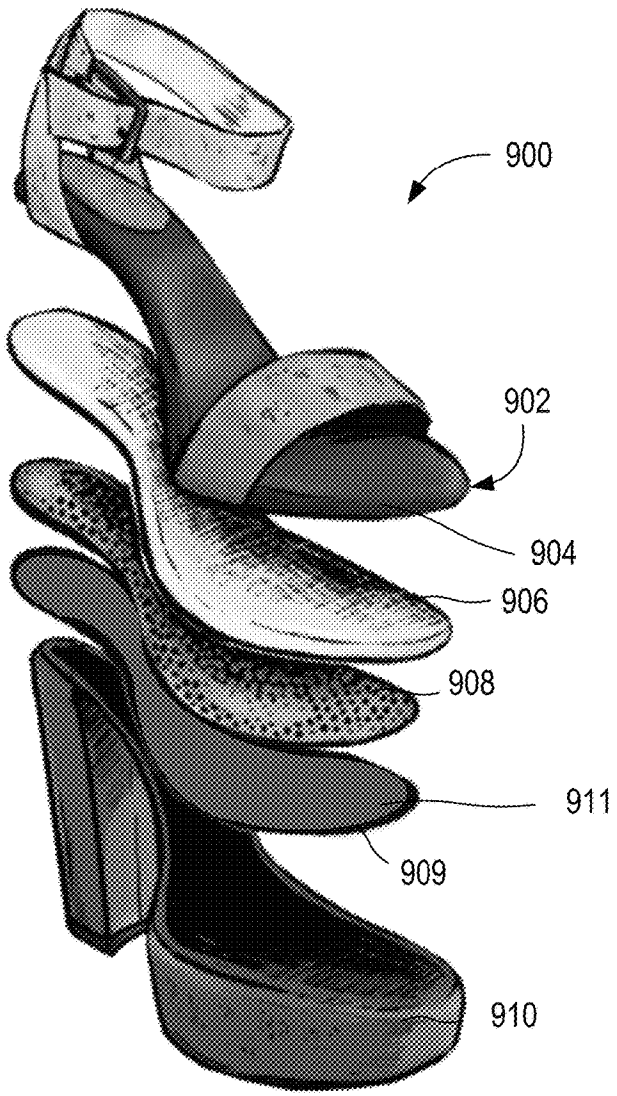
FIG. 9 is a schematic illustration of an exploded view of an improved footwear, according to an embodiment.

FIG. 9 is an exploded perspective view of an example improved footwear 900, according to an embodiment. The footwear 900 can be substantially similar to the improved footwear 100, 200, 300, 400, 500, 600, 700 and/or 800 described above, in structure and/or function. Thus, portions of the footwear 900 are not described in further detail herein. As shown in FIG. 9, the footwear 900 includes an insole 902, an insole lining 904, a first layer 906, a second layer 908, a mid-board 909 and an outsole 910. The second layer 908 of the footwear 900 can be substantially similar to the second layer 108 described with reference to the footwear 100. As shown, the second layer 908 of the footwear 900 is in a non-isolated configuration, extending over and/or close to a full surface area defined by the insole 902 and/or the outsole 910 of the footwear 900. The mid-board 909 can be substantially similar to the mid-board 109 described with reference to the footwear 100. As shown in FIG. 9, the mid-board 909 is configured to multiple indentations 911 defined to at least partially house the non-isolated second layer 908 adjoining the mid-board 909, with the indented portions of the mid-board 909 configured to aid in the second layer 908 molding to the user's foot and/or in holding the second layer 908 in place during use, as described with reference to the mid-board 109 and the second layer 108 above. In some embodiments, the indentations 911 (and/or the contours of the indentations) defined on the mid-board 909 can be configured to limit and/or prevent lateral movement of the one or more layers (e.g., non-isolated portion of the second layer 908), and/or relative lateral movement between the layers (e.g., between the mid-board 909 and the non-isolated portion of the second layer 908 and/or between the first layer 906 and the non-isolated portions of the second layer 908). The illustrated example footwear 900 is an open-toe footwear with a high-heeled outsole 910, the heel being only partially tapered.

While the embodiments described herein are shown to be traditionally a women's style of footwear, the improved footwear 100 described above can include any style of footwear, including, for example, traditional men's footwear. Similarly the footwear 200, 200, 300, 400, 500, and/or 600 described above can be suitably modified to be used as men's footwear, including footwear for any suitable use. For example, the embodiments described herein can be directed towards and/or suitably modified to be directed towards casual footwear, footwear included in sportswear, footwear included in business attire, footwear adapted for children, and the like. The embodiments described herein can also be directed towards specialized footwear used for various health conditions such as orthopedic footwear, footwear adapted for arthritic patients, footwear adapted for diabetic patients, footwear adapted for specialized personnel working in areas like security, hazardous material exposure, athletics, personnel working in confined spaces, and/or personnel working on their feet for extended periods of time, and the like.

Conclusion

In summary, systems, devices and methods are described herein for various embodiments of an improved footwear that provides improved support and comfort, with improved hygiene, during use.

While various embodiments have been described above, it should be understood that they have been presented by way of example only, and not limitation. Where methods described above indicate certain events occurring in certain order, the ordering of certain events may be modified. For example, layers of an improved footwear can be fused and/or sewn together in any suitable order. Additionally, certain of the events may be performed concurrently in a parallel process when possible, as well as performed sequentially as described above.

Where schematics and/or embodiments described above indicate certain components arranged in certain orientations or positions, the arrangement of components may be modified. While the embodiments have been particularly shown and described, it will be understood that various changes in form and details may be made. Any portion of the improved footwear and/or methods described herein may be combined in any combination, except mutually exclusive combinations. The embodiments described herein can include various combinations and/or sub-combinations of the functions, components, and/or features of the different embodiments described.

The invention claimed is:

1. A shoe, comprising:

an outsole, an insole having an insole lining, a first layer of a first material disposed between the outsole and the insole, a second layer of a second material disposed between the first layer and the outsole, and a mid-board disposed between the second layer and the outsole, the second layer being continuous and including a single shock absorbing gel material extending over a distal surface of at least a toe portion of the first layer, and configured to provide restorative forces to correct deformations from compressions on the first layer, the restorative forces configured towards restoring a thickness of the first layer from a compression and reducing seepage, the first layer having a radial edge portion with a first thickness that is less than a second thickness of the remaining portion of the first layer, the first layer and the second layer continuous without an aperture and extending from at least a ball portion of the shoe to a heel portion of the shoe, the mid-board including one or more hollowed portions configured to reduce a weight of the shoe, the insole lining covering an upper portion of the insole, and extending beyond an edge of the insole, the first layer, and the second layer, such that an end portion of the insole lining is fixedly secured to at least one of the second layer or the outsole.

2. The shoe of claim 1, wherein:

the first material is made from memory foam including polyurethane.

3. The shoe of claim 2, wherein:

the shock absorbing gel is made from either a thermoset, polyether-based, polyurethane material or a silicone gel material.

4. The shoe of claim 1, wherein:

the mid-board is made of at least one of cellulosic material or carbon fiber.

5. The shoe of claim 1, wherein at least one of a thickness and a density of at least a toe portion or an arch portion of the insole is different from a thickness or a density of a heel portion of the insole.

6. The shoe of claim 5, wherein the first layer has a thickness of about 3 mm and imparts a shock absorption of 6 to 7 kN.

7. The shoe of claim 1, wherein:

the first layer and the second layer are fused together by compression with no material between the first layer and the second layer.

8. The shoe of claim 1, wherein the first layer has a first radial width smaller than a second radial width of the second layer, the first radial width of the first layer defined by a removal of the radial edge portion.

9. The shoe of claim 1, wherein the one or more hollowed portions are defined on a distal surface of the mid-board.

10. A shoe, comprising:

an outsole, an insole, a first layer of a first material disposed between the outsole and the insole, a second layer of a second material disposed between the first layer and the outsole, the first layer and the second layer fused together with no material between the first layer and the second layer, and a mid-board disposed between the second layer and the outsole, the second layer configured to provide restorative forces towards restoring a thickness of the first layer from a compression and reducing seepage, the first layer and the second layer continuous without an aperture and extending from at least a ball portion of the shoe to a heel portion of the shoe, the first layer including a radial edge portion along a circumference of the shoe having a first thickness less than a second thickness of the remaining portion of the first layer.

11. The shoe of claim 10, wherein the second thickness of the first layer is approximately between 3 mm and 3.175 mm and the first layer has a density of about 27 kg/m$^3$.

12. A method of making a shoe, the method comprising:

providing an insole that extends over a portion of a user's foot when in use, the insole including a portion having a thickness, density, porosity, absorptiveness, permeability, and flexibility different from the remaining insole, a first layer of a first material that extends over a part of a distal surface of the insole, and a second layer of a second material that extends continuously from a heel portion to a toe portion without an aperture over a distal surface of the first layer, the second layer configured to provide restorative forces towards restoring a thickness of the first layer from a compression and reducing seepage from the first layer;

filing a radial edge portion of the first layer along a circumference of the shoe to reduce a thickness of the radial edge portion of the first layer;

fusing the first layer and the second layer together, by applying compression, to form a fused layer, the first layer and the second layer fused together with no material between the first layer and the second layer;

covering an upper portion of the insole with an insole lining such that the insole lining extends beyond an edge of the insole, the first layer, and the second layer;

stretching the insole lining over a first side portion of the first layer and a second side portion of the second layer to form an overhanging end portion of the insole lining;

disposing the end portion of the insole lining between the second layer and an outsole; and fixedly securing the insole lining to at least one of the second layer or the outsole.

13. The method of claim 12, further comprising:

sanding an end portion of the fused layer, to generate a smooth trim, before the covering with an insole lining.

14. The method of claim 12, wherein the second layer is made from a sorbothane gel.

* * * * *